US005277437A

United States Patent [19]

Moats

[11] Patent Number: 5,277,437

[45] Date of Patent: Jan. 11, 1994

[54] SKATE APPARATUS

[76] Inventor: Dan S. Moats, 2502 N. Michigan, Roswell, N. Mex. 88201

[21] Appl. No.: 821,761

[22] Filed: Jan. 23, 1986

[51] Int. Cl.[5] ..... A63C 17/04

[52] U.S. Cl. ..... 280/11.23; 280/11.27

[58] Field of Search ..... 280/7.14, 11.12, 11.19, 280/11.2, 11.23, 11.27; 301/5.3, 5.7, 124 R

[56] References Cited

U.S. PATENT DOCUMENTS

| | | | |
|---|---|---|---|
| 1,268,385 | 6/1918 | Paulsen | 280/11.22 |
| 2,240,532 | 5/1941 | Warner | 280/11.23 |
| 3,156,482 | 11/1964 | Ware | 280/11.2 |
| 3,963,252 | 6/1976 | Carlson | 280/11.22 |
| 4,095,846 | 6/1978 | Agins | 301/63 PW |
| 4,412,685 | 11/1983 | Szamek | 280/11.19 |
| 4,666,168 | 5/1987 | Hamill et al. | 280/11.2 |

*Primary Examiner*—Richard M. Camby
*Attorney, Agent, or Firm*—Gregg I. Anderson

[57] ABSTRACT

An improved apparatus is disclosed and preferably includes a bifurcated truck assembly that is interlockingly and removably attached to a sole plate, as well as a quick-change wheel and axle apparatus. At least in a two-wheeled version of the roller skate apparatus, the wheels preferably include a generally flat horizontal central portion on the ground-engaging wheel periphery in order to provide greater ease and stability in two-wheeled skating.

29 Claims, 5 Drawing Sheets

SKATE APPARATUS

BACKGROUND AND SUMMARY OF THE INVENTION

The invention relates generally to roller skates, or roller skate-type devices, and more particularly to support structure assemblies and axle wheel assemblies therefor.

In light of the recent emphasis on, and greatly increased participation in, physical activities and competitive sports, both recreational and competitive roller skating has emerged as a more significant and sophisticated pastime than it was in the past. As a result, the emphasis upon the production of sophisticated and high quality roller skating equipment has rapidly increased. Furthermore, both two and four-wheeled roller skating has been used to train and condition participants even in non-roller skating athletic programs.

Because of the increased significance and sophistication of roller skating, in both competitive and training activities, the materials and designs for wheels and other skate equipment have become quite specialized for various applications and purposes. As a result, some wheels and other equipment have specialized configurations or compositions that are not well-suited for a wide variety of skating applications. Furthermore, especially in the area of two-wheeled roller skating, such specialization and sophistication of wheels and other skate equipment has been found to require a relatively high amount of instruction and training in order to allow participants, especially beginners, to use them. Accordingly, the need has arisen for roller skate equipment that has a high degree of adaptability for various specialized activities, while still maintaining a high degree of sophistication and suitability for such divergent activities. Furthermore, the need has arisen, especially in two-wheeled roller skating, for equipment that allows earlier participation by the beginner, without sacrificing the unique effects and benefits of two-wheeled skating.

A roller skate wheel member has a generally toroidal configuration with a ground-engaging peripheral surface extending circumferentially therearound. In this embodiment of the invention, which is particularly adapted for two-wheeled roller skates, the ground-engaging peripheral surface of each wheel member includes an axially central portion that is generally flat in its diametric cross-sectional configuration and that preferably extends axially in a direction generally parallel to the wheel member's axis of rotation. Preferably, the ground-engaging peripheral surface of each wheel member further includes an arcuate portion disposed axially adjacent one or both sides of the central portion and which curves generally radially inwardly therefrom.

A truck assembly of the roller skate is attachable to a sole plate by interlocking means, preferably without the necessity of threaded or other types of fasteners extending between and interconnecting the truck assembly and the sole plate.

Additional objects, advantages, features and embodiments of the present invention will become apparent from the following description and appended claims, taken in conjunction with the accompanying drawings.

DETAILED DESCRIPTION OF THE PREFERRED EMBODIMENTS

Figure 1:
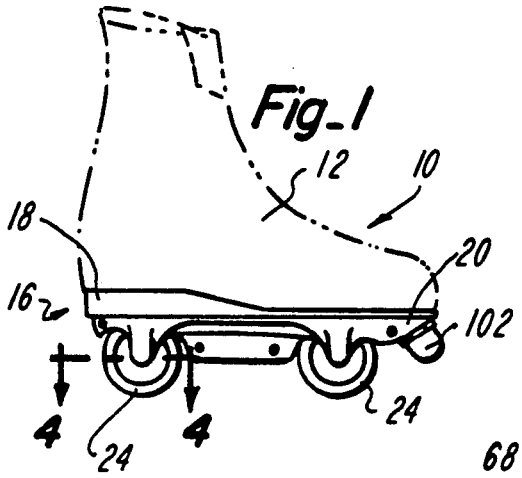
FIG. 1 is a side elevational view of an exemplary roller skate according to the present invention, with its boot, shoe or other footwear item shown in phantom lines.

FIGS. 1 through 22 depict an improved roller skate apparatus according to the present invention. One skilled in the art will readily recognize from the following discussion that the various embodiments of the invention are equally applicable to roller skate apparatus having virtually any number of wheels, axles, and combinations thereof, as well as being applicable to other skate-like devices.

FIGS. 1 through 4 illustrate a roller skate 10, generally including a boot, shoe, or other similar footwear 12, supported and suspended upon a support structure assembly 16. The support structure assembly 16 generally includes a sole plate 18 with a truck assembly 20 removably attachable to a lower surface 22 of the sole plate 18 in the exemplary roller skate 10. A pair of wheels 24 include bearing members or assemblies 28 thereon and are removably mounted on the support structure assembly 16 for rotation about their respective axles 26. It should be understood, however, that the exemplary roller skate 10 can include more than two wheels 24 and can have more than one wheel 24 rotatably mounted upon one or more of the axles 26.

Figure 4:
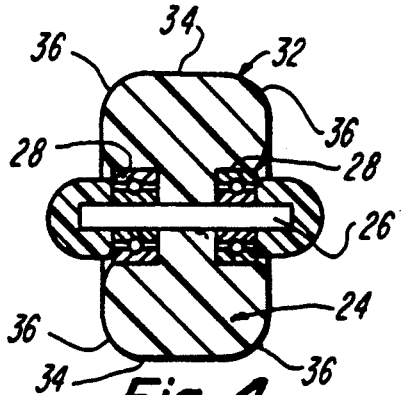
FIG. 4 is a cross-section view taken generally along line 4—4 of FIG. 1.

The wheels 24 can be composed of various durable materials known to those skilled in the art, such as polyurethane, polycarbonate, or light-weight metals, and are formed in a generally toroidal configuration, with a ground-engaging peripheral surface 32 extending around their circumference. At least in the illustrated exemplary two-wheeled version of the roller skate 10, the ground-engaging peripheral surface 32 preferably includes a central portion 34 that is generally flat in its diametric cross-section and that extends axially in a direction generally parallel to the axles 26 of the wheel 24, as shown in FIG. 4. The ground-engaging peripheral surface 32 also includes at least one, and preferably two, arcuate portions 36 disposed axially adjacent the central portion 34 and curving generally radially inwardly therefrom. Preferably, the flat central portion 34 has an axial width of at least 50% of the total axial width of the wheel 24.

Figure 16:
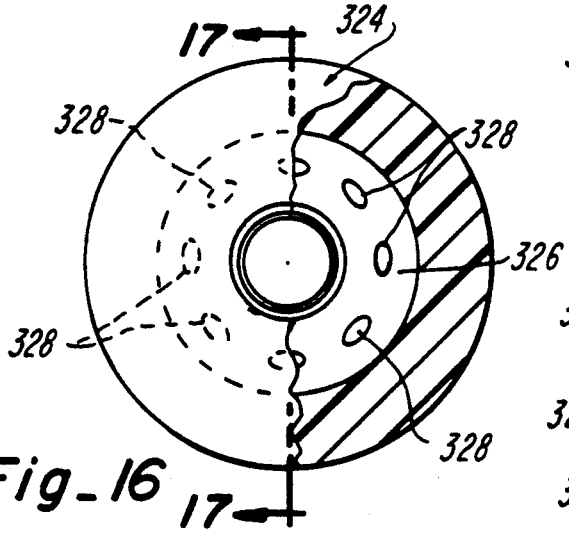
FIG. 16 is a side elevational view of an optional wheel construction, with a portion of the wheel broken away to illustrate an internal reinforcing member.
Figure 17:
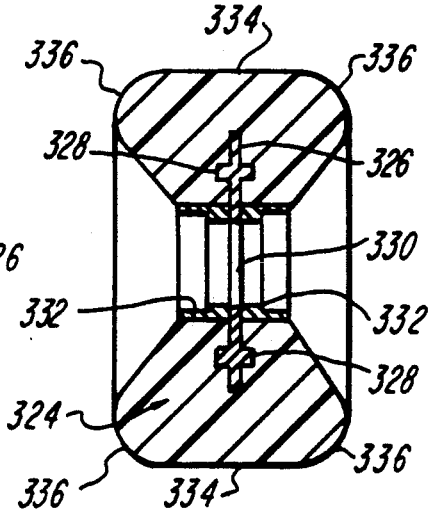
FIG. 17 is a cross-sectional view taken generally along line 17—17 of FIG. 16.

FIGS. 16 and 17 illustrate a wheel 324, which is an optional high-strength, reinforced version of the wheel 24, and which includes arcuate portions 336 and a flat central portion 334 corresponding generally to the above-discussed arcuate portions 36 and flat central portion 34, respectively. The optional wheel 324 includes an internal annular reinforcing disc 326, with circumferentially-spaced protuberances 328 on its axially-facing sides and a central axle-receiving opening 330 therethrough. The wheel 324 also includes generally cylindrical bushings 332 for receiving the axle 26 and any required bearings (not shown). The reinforcing disc 326 and the bushings 332 are integrally molded with the above-mentioned durable material of the wheel 324, and the protuberances 328 help to securely grip the moldable wheel material as it forms. The reinforcing disc 326 adds significant strength to the wheel 324, while still preserving any resiliency and adherence characteristics of the wheel material.

As shown in FIGS. 2, 3, and 5 through 9, one preferred embodiment of the truck assembly 20 includes at least a pair of truck members **40*a* and 40*b* adapted to be removably attached to one another in a generally mutual mating relationship along their respective mutual mating surfaces 42*a* and 42*b*. The preferred truck members 40*a* and 40*b* each include a number of corresponding forward axle support portions 44*a* and 44*b*, and a number of corresponding rearward axle support portions 45*a* and 45*b*, respectively. At least one of the forward axle support portion combinations 44*a* and 44*b* is preferably located so as to be centered under the ball of the skate-wearer's foot, and at least one of the rearward axle support portion combinations 45*a* and 45*b* is preferably centered under the wearer's heel. The exact number of such axle support portions in a given application, however, corresponds to the number of axles 26**.

At least one (and preferably both) of the axle support portions **44*a* or 44*b* and 45*a* or 45*b* on the respective truck members 40*a* or 40*b*, respectively, preferably has an end portion of its respective axle 26 press-fit into an aperture 46 or otherwise substantially fixed thereto. The corresponding axle support portion (or portions) on the other of the truck members 40*a* or 40*b* include a corresponding axle-receiving aperture 48, or other suitable means for removably engaging and supporting the axle, therein. The preferred axle receiving apertures 48 are adapted to slidably receive the opposite ends of the respective axles 26 in a supporting slip-fit relationship therewith such that the wheels 24 may be slidably mounted on, or removed from, their axles 26 when the truck members 40*a* and 40*b* are separated. Accordingly, when the wheels 24 are mounted on their axles 26, and the truck members 40*a* and 40*b* are removably attached to one another, the wheels 24 are restrained on the truck asembly 20 but are freely rotatable about their respective axles 26. It should be noted that the truck members 40*a* and 40*b* can be removably attached to one another by way of a number of threaded fasteners 50, for example, extending through apertures 52*a* and 52*b* in the truck members 40*a* and 40*b*, respectively. One skilled in the art will readily recognize, however, that other suitable attachment means may alternatively be employed for removably attaching the truck members 40*a* and 40*b*** to one another.

Referring primarily to FIGS. 2, 3, and 5 through 12, the lower surface 22 of the sole plate 18 preferably includes a forward interlock member 56, an intermediate interlock member 58, and a rearward interlock member 60, all in the form of downwardly-protruding surface discontinuities thereon. Correspondingly, the truck assembly 20 includes openings therein, which form a forward interlock receptacle 62, an intermediate interlock receptacle 64 and a rearward interlock receptacle 66 between the truck members **40*a* and 40*b*. As will be described in detail below, the interlock receptacles 62, 64 and 66 are adapted for interlockingly and removably receiving and engaging the corresponding interlock members 56, 58 and 60, respectively, in order to removably and interlockingly attach the sole plate 18 and the truck assembly 20 to one another. It should be noted that although three sets of interlock member and interlock receptacle combinations are shown for purposes of illustration in the drawings, the sole plate 18 and the truck assembly 20** may include one or more of such combinations.

The interlock members 56, 58 and 60 include undercut edge portions 68, 70 and 72 preferably extending around at least a substantial portion of their respective peripheries. Preferably, at least the forward interlock member 56 and the rearward interlock member 60 are generally plate-shaped in configuration, with their respective undercut edge portions 68 and 72 beveled generally upwardly and inwardly toward the bottom surface 22 of the sole plate 18 such that the lower surface area of the interlock members 56 and 60 is greater than their corresponding horizontal cross-sectional areas.

The forward interlock receptacle 62, the intermediate interlock receptacle 64, and the rearward interlock receptacle 66 are defined at least in part by respective peripheral walls 74, 76 and 78. The peripheral walls 74, 76 and 78 include undercut peripheral wall portions 80, 82 and 84, respectively, on at least part of their peripheries. The undercut peripheral wall portions 80, 82 and 84 of the respective interlock receptacles 62, 64 and 66 are adapted to interlockingly and removably engage the corresponding undercut edge portions 68, 70 and 72 of the corresponding interlock members 56, 58 and 60, respectively.

Preferably, at least the intermediate interlock member 58 is defined by an elongated generally rod-shaped member 86 extending generally longitudinally along the lower surface 22 of the sole plate 18 and interconnected therewith by an elongated interconnecting member 88. The lateral width of the interconnecting member 88 is less than that of the rod-shaped member 86 in order to form the above-mentioned undercut edge configuration 70. Correspondingly, the undercut wall portion 82 of ther intermediate interlock receptacle 64 has a configuration that is receivingly complementary to that or the undercut edge portion 68 formed and defined by the rod-shaped member 86 and the interconnecting member 88, thereby providing for the above-discussed removable and interlocking engagement.

In the preferred embodiment of the support structure assembly 16, the mutual mating surfaces 42*a* and 42*b* of the truck members 40*a* and 40*b*, respectively, extend longitudinally generally along the longitudinal centerline 90 of the truck assembly 20. Preferably, the centerline 90 is generally colinear with the longitudinal centerline 92 of the sole plate 18 when the truck members 40*a* and 40*b* are attached to one another with the truck assembly 20 removably attached to the sole plate 18. The interlock members 58, 60 and 62 are preferably located on the sole plate 18 such that they are each bisected into two generally equal parts by the longitudinal centerline 92, and the corresponding interlock receptacle 62, 64 and 66 are preferably symmetrically formed along or adjacent to the respective mutual mating surfaces 42*a* and 42*b* of the truck members 40*a* and 40*b*. Therefore, when the truck members 40*a* and 40*b* are moved into their mutual mating engagement, while in contact with the lower surface 22 of the sole plate 18, the interlock receptacle 62, 64 and 66 interlockingly receive and engage the interlock members 56, 58 and 60, respectively, as described above.

The attachment of the truck members 40*a* and 40*b* to one another, can be by way of the exemplary threaded fasteners 50 extending through the apertures 52, for example, and therefore serves to secure the truck assembly 20 to the sole plate 18 because of the above-mentioned interlocking engagement of the interlock members and their corresponding interlock receptacles. Preferably, either the interlock members 56, 58 and 60, or at least the portions of the truck members 40*a* and 40*b* adjacent the interlock receptacles 62, 64, and 66, are composed of a resilient and compliant material in order to assure a relatively tight interlocking engagement between the interlock members and their corresponding interlock receptacles.

Figure 18:
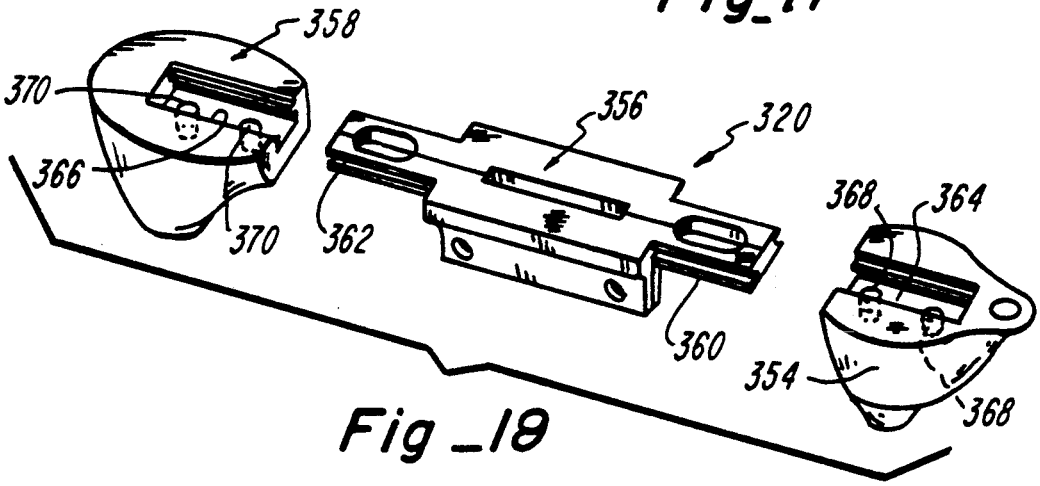
FIG. 18 is an exploded perspective view of another embodiment of the truck member assembly according to the present invention.

As shown in FIG. 18, an alternative optional truck assembly 320 can be provided with a forward portion 354, an intermediate truck member portion 356, and a rearward portion 358. The intermediate portion 356 is split into laterally separable truck members along a longitudinal separation line and includes interlock receptacles, generally similar to those of the truck members 40 discussed above, for releasably securing the truck assembly 320 in a sole plate (not shown) in a manner similar to that described above in connection with the truck assembly 20. The intermediate truck member portion 356 includes forward and rearward tongue portions 360 and 362, respectively, that slidably and adjustably engage corresponding slots 364 and 366 on the forward and rearward portions 354 and 358, respectively. The tongue portions 360 and 362 have a configuration wherein they interlock in a tongue-and-groove sliding engagement with the respective slots 364 and 366. This sliding engagement further allows the overall length of the truck assembly 320, as well as the longitudinal positions of the front and rear axles and wheels, to be selectively altered and adjusted to suit the individual user or to adapt to a particular skating application. Once the longitudinal positions of the forward portion 354 and the rearward portion 358 are pre-selected or adjusted relative to the intermediate portion 356, they are each releasably locked in place by one or more set screws 368 and 370 engaging the respective tongue portions 360 and 362, or by way of other suitable releasable fastening or retaining means.

Figure 11:
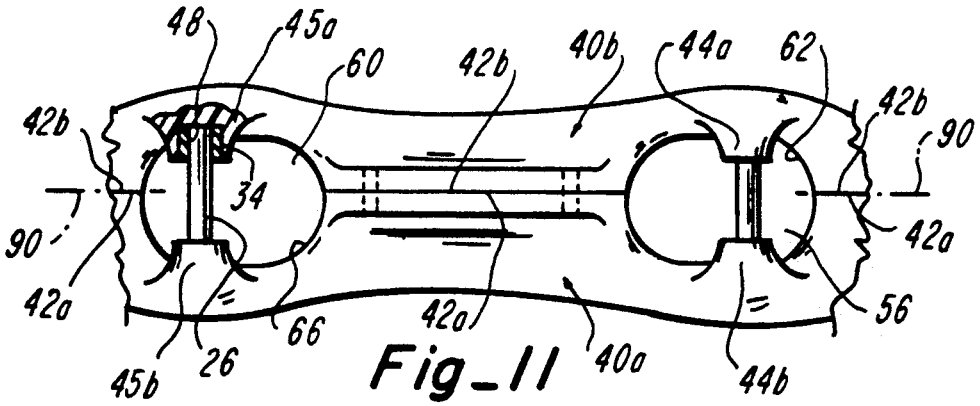
FIG. 11 is a partial bottom view of the truck members of FIG. 8, shown in a mutually mating engagement with one another.
Figure 12:
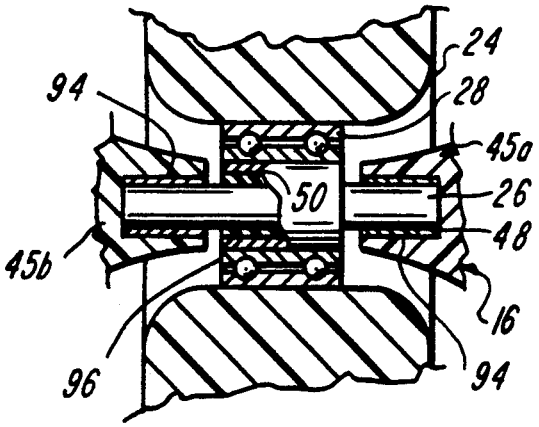
FIG. 12 is a partial cross-section view, taken through a wheel and axle assembly, illustrating an alternate embodiment of the axle and bearing assembly of the invention.
Figure 13:
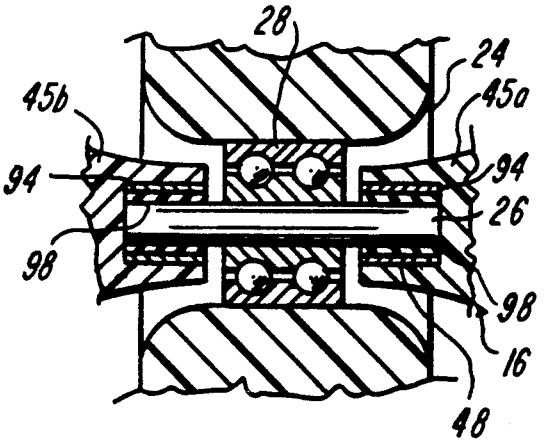
FIG. 13 is a cross-sectional view similar to that of FIG. 12, but illustrating still another alternative axle and wheel bearing embodiment.

Referring primarily to FIGS. 11 through 13, at least one of the sets of the forward axle support portions 44*a* and 44*b*, or the rearward axle support portions 45*a* and 45*b*, can optionally include insert sleeves 94 in their respective axle receiving apertures 48 for receiving and engaging their respective axles 26. Whether or not such insert sleeves 94 are employed, the bearing assemblies 28 can optionally include a resilient bearing sleeve 96 disposed between the bearing assembly 28 (or an inner bearing sleeve portion 30 thereof) and the axle 26. The resilient bearing sleeve 96 resiliently suspends the support structure assembly 16 relative to the wheel members 24 and resiliently allows for movement or shifting of the axis of rotation of the wheel members 24 relative to the axles 26. Such relative movement or shifting can occur during any of a number of roller skating maneuvers, such as cornering, for example.

Figure 20:
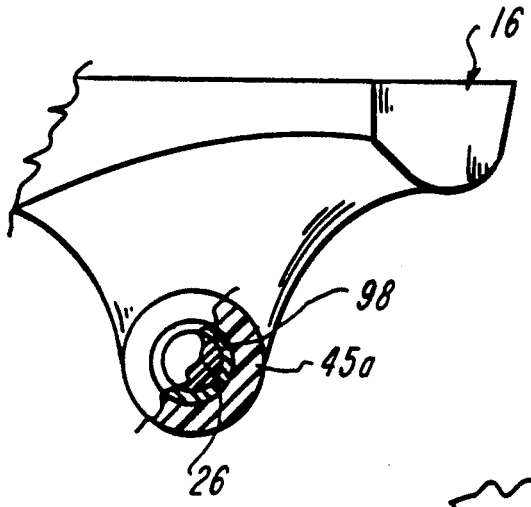
FIG. 20 is a partial elevational view of another embodiment of the truck member assembly, according to the present invention, having an alternate axle support portion.
Figure 21:
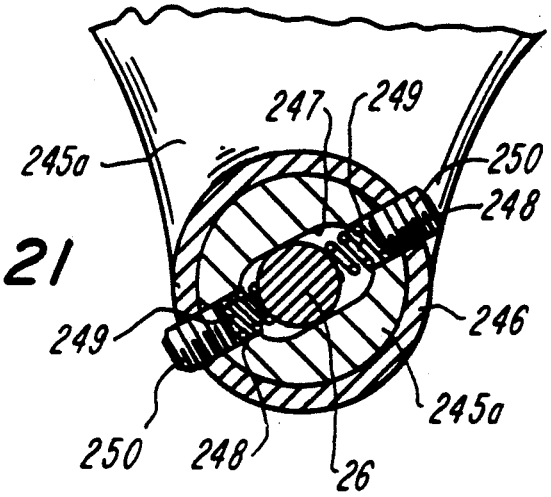
FIG. 21 is a view similar to that of FIG. 20, but illustrating still another alternate axle support portion.

FIGS. 13, 20 and 21 illustrate alternate configurations for providing resiliency between the wheels 24 and the support structure assembly 16. As shown in FIG. 13, at least one bearing member 28 of a wheel 24 directly engages the corresponding axle 26, and resilient insert sleeves 98 are disposed between the axle 26 and the insert sleeves 94 of the support structure assembly 16 (or directly between the axle 26 and the support structure assembly 16, as shown in FIG. 20). Both the resilient bearing sleeves 96 and the resilient insert sleeves 98, shown alternatively in FIGS. 12, 13 and 20, are preferably comprised of an elastomeric material and have a generally cylindrical configuration with an aperture having at least one open end and extending axially therethrough.

In FIG. 21, still another alternate configuration for providing resiliency is illustrated, wherein an alternate axle support portion 245*a* (or 245) is partially surrounded and reinforced by an outer sleeve 246 and includes a radially elongated opening extending axially through a portion thereof for receiving the axle 26. One or more spring members 249 are received in respective radially-extending apertures 248 and are restrained and compressed preferably by respective retaining screws 250 or other suitable retaining devices. The desired degree of resiliency between the axle 26 and the support assembly 245*a* can be adjustably obtained by tightening or loosening the retaining screws 250. Furthermore, the radial direction of the centerlines of the apertures 248 can be predetermined in order to derive specific desired resiliency characteristics for a given application. By orienting the apertures 248 along lines that are included between the horizontal and vertical directions, however, both vertical and horizontal resiliency is obtained.

Figure 19:
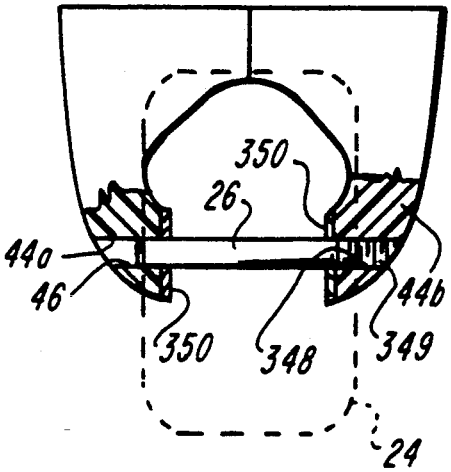
FIG. 19 is a rear elevational view illustrating still another embodiment of the truck member assembly, axles and wheels according to the present invention.

FIG. 19 illustrates a quick-change wheel and axle arrangement, wherein one of the axle receiving portions 44*a* or 44*b* has an axial opening 348 therethrough for receiving a retaining screw (or another retaining device) 349 therein. The retaining screw 349 may be removed to in turn allow the axle 26 to be removed through the opening 348. In order to prevent or retard undesirable wear or enlargement of the apertures 46 or 348, the axle receiving portions 44*a* and 44*b* can optionally be equipped with end plates 350.

It should further be noted that any of the above-discussed embodiments of the roller skate apparatus according to the present invention can also optionally include a toe stop device on its forward end. Such toe stop devices are frequently desirable for allowing the wearer of the roller skate to merely tip the skate forward such that the top stop member frictionally engages the ground or floor upon which the wearer is skating and acts as a brake for slowing or halting his or her progress.

Figure 2:
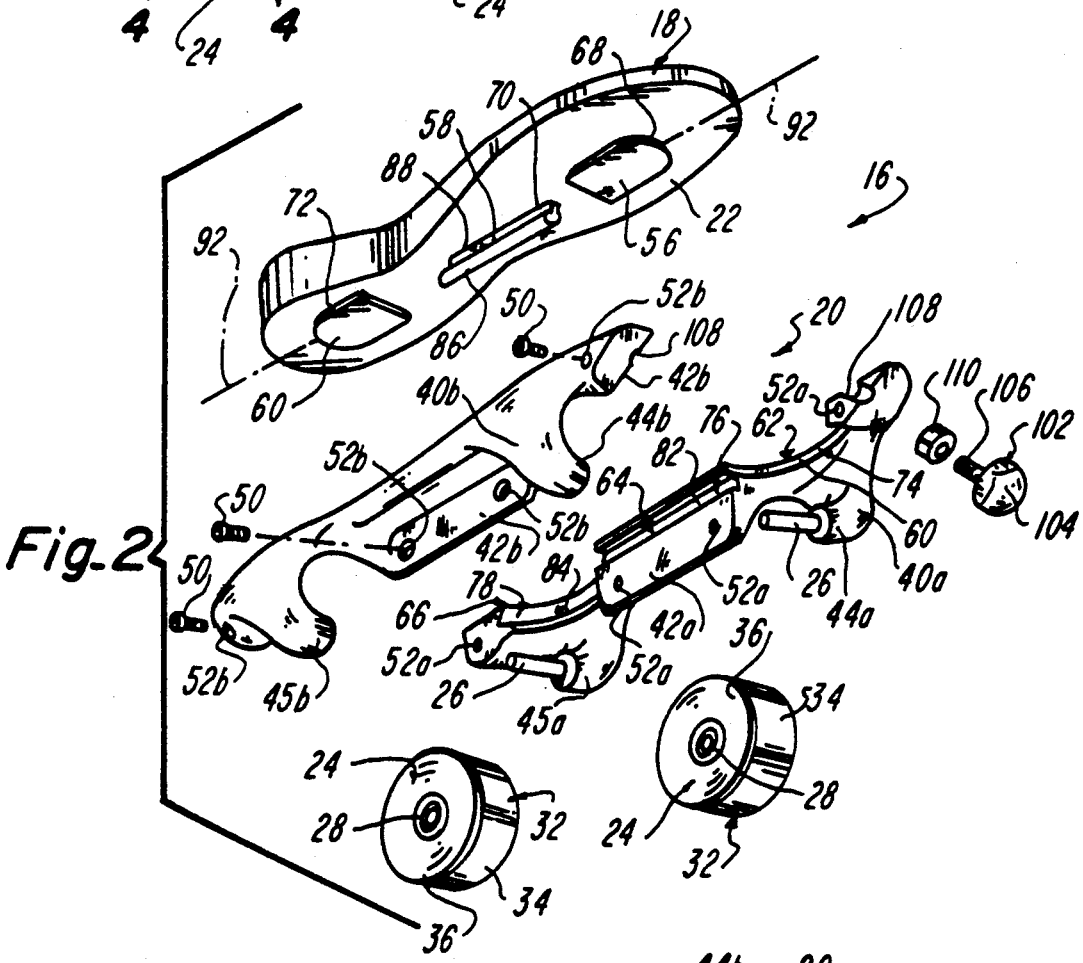
FIG. 2 is an exploded perspective view of one preferred embodiment of the support structure assembly, axles and wheels, according to the present invention, for the roller skate of FIG. 1.
Figure 3:
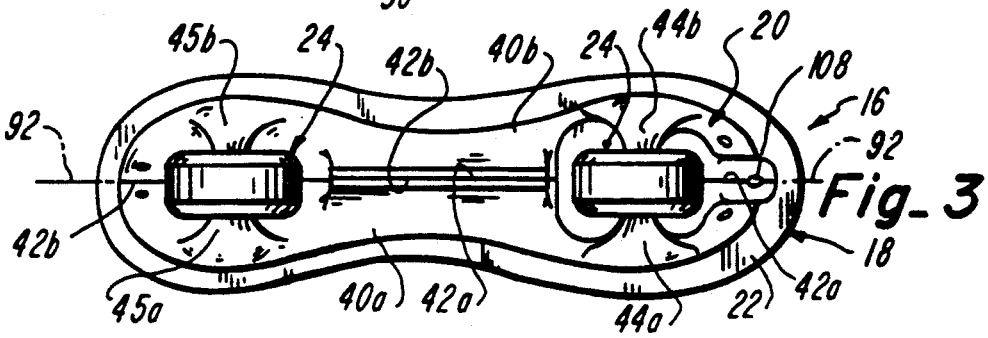
FIG. 3 is a bottom view of the roller skate assembly of FIG. 1, incorporating the support structure assembly and wheels of FIG. 2.
Figure 5:
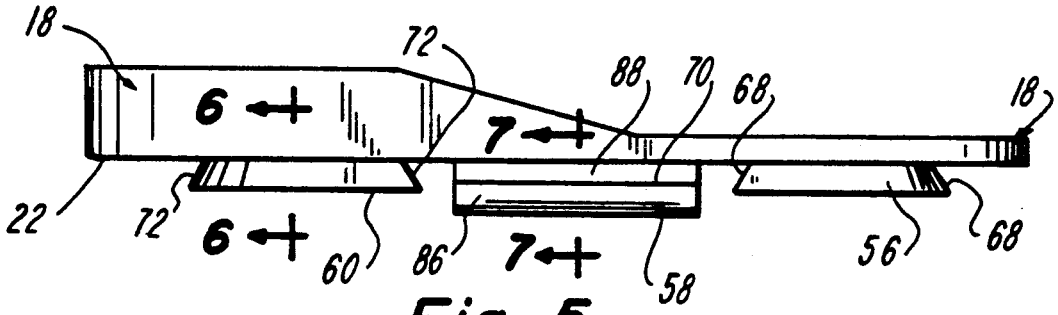
FIG. 5 is a side elevational view of the sole plate portion of the support structure assembly of FIG. 2.
Figure 6:
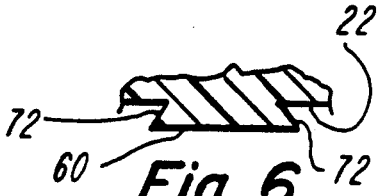
FIG. 6 is a partial cross-sectional view taken generally along line 6—6 of FIG. 5.
Figure 7:
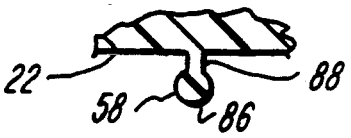
FIG. 7 is a partial cross-sectional view taken generally along line 7—7 of FIG. 5.
Figure 8:
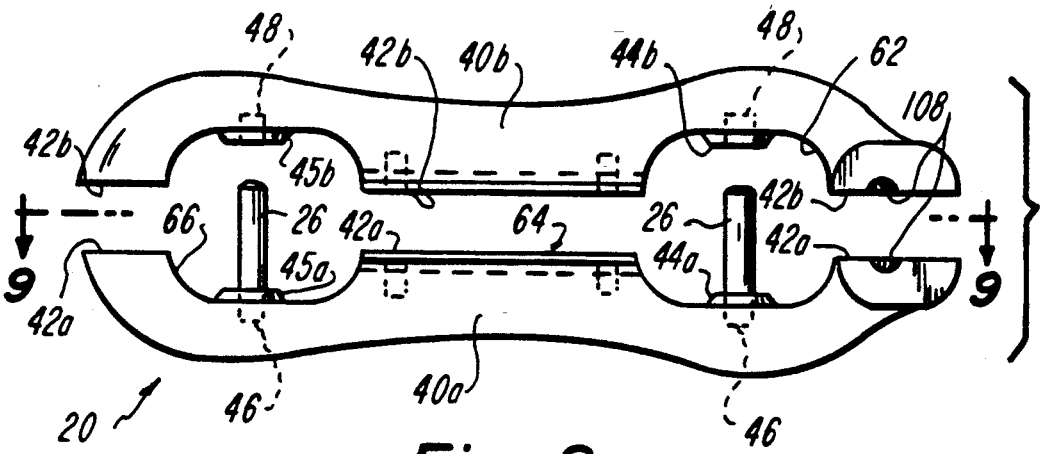
FIG. 8 is a top view of the truck members of the support structure assembly of FIG. 2 in their detached condition.
Figure 9:
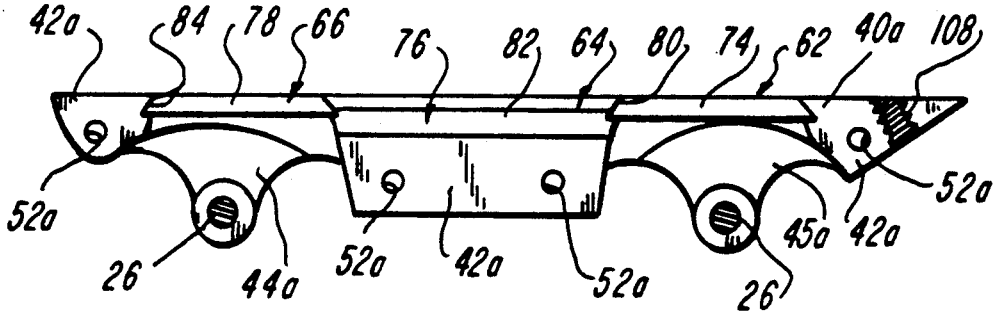
FIG. 9 is a side elevational view of one of the truck members of the support structure assembly of FIG. 2, looking generally in the direction of arrow 9—9 of FIG. 8.
Figure 10:
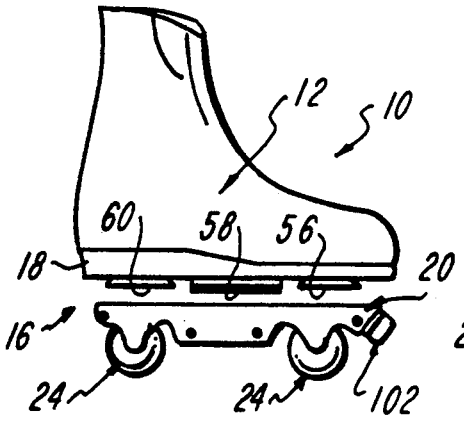
FIG. 10 is a side elevational view of one embodiment of the invention wherein the sole plate is incorporated into the sole portion of a skating boot or other skating footwear.

In FIG. 2, one embodiment of a toe stop apparatus 102 includes a frictional element 104 and a threaded rod member 106 adapted to threadably engage a threaded aperture 108 in the truck assembly 20. By rotating the toe stop apparatus 102 the position of the friction element 104 relative to the truck assembly 20 may be adjusted to provide the desired clearance between the friction element 104 and the ground or floor upon which the user is skating. Once the desired relative position between the friction element 104 and the truck assembly 20 is achieved, a jam nut 110 may be threadably tightened into engagement with the truck assembly 20, thereby substantially preventing the toe stop apparatus 102 from undesired rotation.

Figure 14:
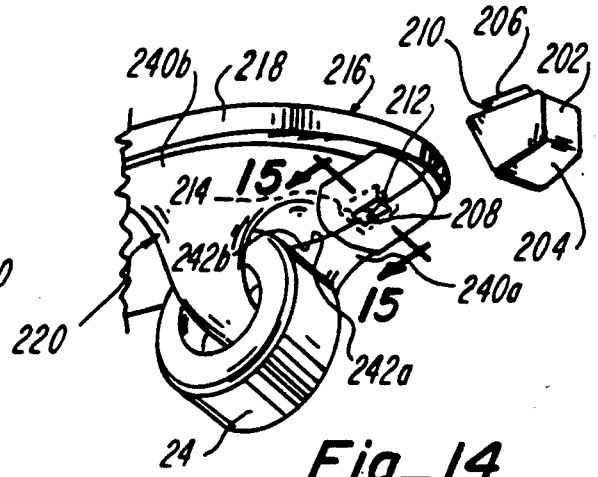
FIG. 14 is a partial exploded perspective view of a support structure assembly, illustrating a stop member adapted to be removably attached thereto.

FIG. 14 illustrates an alternate toe stop apparatus 202 including a friction element 204 with an integral interlock member 206 thereon. In the embodiment illustrated in FIG. 19, the truck assembly 220 includes an interlock receptacle 208 located on a forward portion thereof and adapted for interlockingly and removably receiving the interlock member 206 therein. Like the interlock members 56 and 58 and the interlock receptacles 62 and 66 described above, the interlock member 206 includes a beveled undercut edge portion 210 which is interlockingly and removably engageable with an undercut peripheral wall portion 214 of a peripheral wall 212 that at least in part defines the interlock receptacle 208. the interlock receptacle 208 is preferably located on the truck assembly 220 so that it is bisected into two generally equal parts when the truck members 240*a* and 240*b* are separated along their respective mutually mating surfaces 242*a* and 242*b*. Thus, when the truck members 240*a* and 240*b* are attached to one another with the interlock member 206 interlockingly received by the interlock receptacle 208, the toe stop apparatus 202 is securely attached to the truck assembly 220. Preferably, either or both of the interlock member 206 or the portion of the truck members surrounding the interlock receptacle 208 are composed of a resilient compliant material in order to assure a relatively tight interlocking engagement therebetween.

Figure 15:
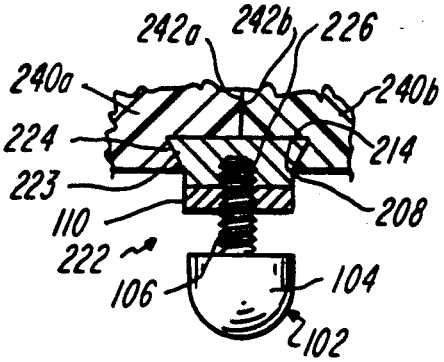
FIG. 15 is a partial cross-sectional view taken generally along line 15—15 of FIG. 14, but illustrating an adjustable stop member embodiment removably attachable to the support structure assembly.

FIG. 15 illustrates still another alternate toe stop apparatus 222 having a separate interlock member 223 with an undercut edge portion 224 thereon, that is generally similar to the interlock member 206 and the undercut portion 210 shown in FIG. 19 and described above. the interlock member 222 and the undercut edge portion 224 are adapted to be interlockingly and removably received within the above-described interlock receptacle 208 in the truck assembly 220. Instead of having an integral friction element, however, the interlock member 223 of the toe stop apparatus 222 includes a threaded aperture 226 therein for threadably receiving the threaded rod member 106 of the toe stop apparatus 102 shown in FIG. 2 and discussed above. Thus, either before or after the separate interlock member 223 is interlockingly attached to the truck assembly 220, the toe stop apparatus 102 may be threadably rotated as described above in order to adjust the relative position between the friction element 104 and the interlock member 223. As described above, when the desired relative position is obtained, the jam nut 110 is threadably tightened into engagement with the interlock member 223 in order to substantially fix the position of the friction element 204 relative to the truck assembly 220. It should be noted that the toe stop arrangements shown in FIGS. 2, 14 and 15 may be employed in conjunction with any of the embodiments of the invention shown and described herein. It should also be noted that such toe stop arrangements are equally applicable and adaptable to stop members located at other than toe or forward locations on the roller skate.

Figure 22:
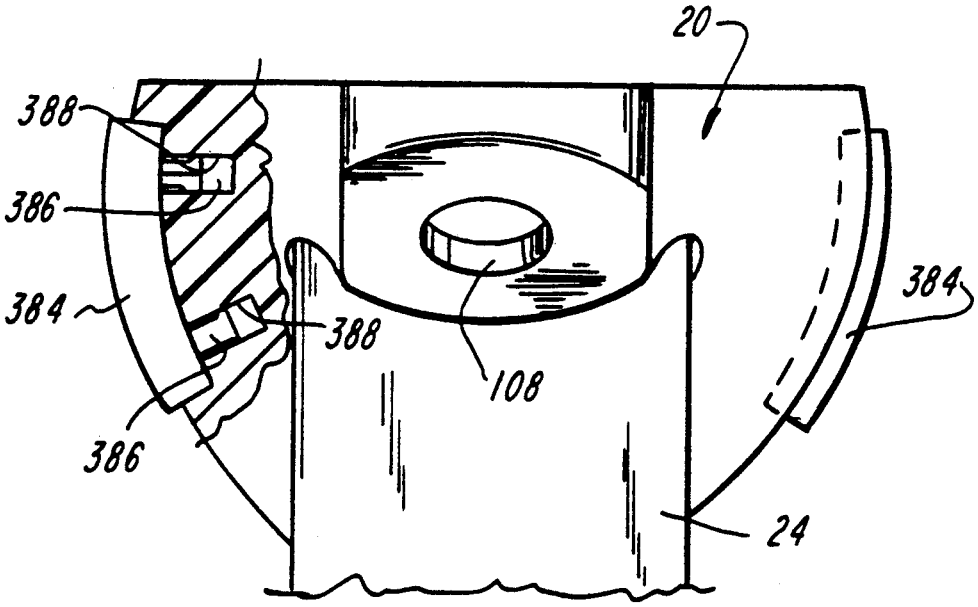
FIG. 22 is a front elevational view, illustrating still another embodiment of a truck member assembly, according to the present invention, having replaceable bumper members on the lateral sides.

FIG. 22 is a front elevational view of the truck assembly 20, with optional side bumper members 384 attached thereto. The side bumper members 384, which are preferably composed of a resilient material, prevent or at least minimize the scuffing of the lateral sides of the truck assembly 20 or other portions of the roller skate 10 (FIG. 1). The replaceable bumper members 384 which may also be mounted at other locations on the truck assembly, forward, rearward or intermediate, preferably have integral pins protruding therefrom that are frictionally inserted into corresponding apertures 388 in the truck assembly 20. Alternatively, the bumper members 384 can be releasably attached to the truck assembly by other suitable retention means known to those skilled in the art.

The foregoing discussion discloses and describes exemplary embodiments of the present invention. One skilled in the art will readily recognize from such discussion that various changes, modifications and variations may be made therein without departing from the spirit and scope of the invention as defined in the following claims.

I claim:

1. In a roller skate having a sole plate, a truck assembly for supporting said sole plate, and at least two wheels rotably mounted on the truck assembly, the improvement wherein said sole plate includes an interlock member having at least one undercut edge portion thereon, the truck assembly including at least a pair of truck members laterally separable from one another along a longitudinal separation line and removably securable to one another, at least one interlock receptable on said truck assembly being defined at least in part by a peripheral wall including at least one undercut peripheral wall portion thereof, said undercut peripheral wall portion of said interlock receptacle being adapted to interlockingly and removably engage a corresponding undercut edge portion of said interlock member, said interlock receptacle further bisected by said separation line for removably and interlockingly securing said sole plate to said truck assembly when said truck members are secured to one another.

2. The invention according to claim 1, wherein the sole plate includes a number of said interlock members and the truck assembly includes a corresponding number of said interlock receptacles.

3. The invention according to claim 1, wherein the truck assembly is split into a pair of truck members removably engageable with one another along mutually mating surfaces thereon, said interlock receptacle and said undercut wall portion being formed on said truck members adjacent said mutually mating surfaces such that said interlock receptacle is bisected into two parts when said truck members are removed from one another, and attachment means for removably securing said truck members to one another in said mutual engagement with said undercut edge portion of said interlock member removably and interlockingly engaging said undercut wall portion of said interlock receptacle in order to removably and interlockingly secure the sole plate to the truck assembly.

4. The invention according to claim 3, wherein the sole plate includes a number of said interlock members and the truck assembly includes a corresponding number of said interlock receptacles, at least one of said interlock members being generally plate-shaped in configuration and disposed on a bottom surface of said sole plate, said undercut edge portion of said at least one plate-shaped interlock member being of a generally beveled configuration extending generally upwardly and inwardly toward said bottom surface of said sole plate, said undercut wall portion of at least one of said interlock receptacles being of a generally beveled configuration generally complimentary to that of said undercut edge portion of said at least one plate-shaped interlock member in order to removably and interlockingly engage said undercut edge portion of said at least one plate-shaped interlock member when said truck members are attached to one another along said mutually mating surfaces with said truck members engaging said bottom surface of said sole plate.

5. The invention according to claim 4, wherein said at least one plate-shaped interlock member is located on said bottom surface of said sole plate such that said at least one plate-shaped interlock member is bisected into two generally equal parts by the longitudinal center line of the sole plate, said mutually mating surfaces of said truck members extending generally along the longitudinal center line of the truck assembly.

6. The invention according to claim 3, wherein the sole plate includes a number of said interlock members and the truck assembly includes a corresponding number of said interlock receptacles at least one of said interlock members comprising an elongated generally rod-shaped member extending generally longitudinally along a bottom surface of said sole plate and an elongated generally longitudinally-extending interconnecting member between said rod-shaped member of said bottom surface, the lateral width of said interconnecting member being less than that of said rod-shaped member in order to form said undercut peripheral edge portion of said interlock member.

7. The invention according to claim 6, wherein said elongated rod-shaped and interconnecting members extend longitudinally generally along the longitudinal center line of the sole plate, said mutually mating surfaces of said truck members also extending generally along the longitudinal center line of the truck assembly, at least one of said interlock receptacles being longitudinally elongated and having a lateral cross-sectioned shape generally complimentary to that of said rod-shaped and interconnecting members in order to removably and interlockingly engage the same.

8. The invention according to claim 7, wherein at least one of other of said interlock members is generally plate-shaped in configuration and disposed on said bottom surface of said sole plate, said undercut edge portion of said at least one plate-shaped interlock member being of a generally beveled configuration extending generally upwardly and inwardly toward said bottom surface of said sole plate, said undercut wall portion of at least one other of said interlock receptacles being of a generally beveled configuration generally complimentary to that of said undercut edge portion of said at least one plate-shaped interlock member in order to removably and interlockingly engage the same when said truck members are attached to one another along said mutually mating surfaces with said truck members engaging said bottom surface of said sole plate.

9. The invention according to claim 8, wherein at least one plate-shaped interlock member is located on said bottom surface of said sole plate such that said at least one plate-shaped interlock member is bisected into two generally equal parts by the longitudinal center line of the sole plate.

10. The invention according to claim 9, wherein the sole plate includes two of said plate-shaped interlock members and one of said rod-shaped interlock members, one of said plate-shaped interlock members being located at a generally forward portion of said sole plate and the other of said plate-shaped members being located at a generally rearward portion of said sole plate, said rod-shaped interlock member being located at an intermediate location on said sole plate generally between said plate-shaped interlock members, the interlock receptacles corresponding to said plate-shaped and rod-shaped interlock members being located at corresponding locations on the truck assembly.

11. In a roller skate having a sole plate, a truck assembly for supporting said sole plate, and at least two wheels rotatably mounted on the truck assembly, the improvement wherein the sole plate includes a first interlock member projecting from said sole plate, the truck assembly having two truck members including a second interlock member extending along the longitudinal axis of the skate and having an undercut edge on one of the truck members with a corresponding surface on the other truck member one interlock receptacle thereon interlocking and removably receiving said first interlock member on said sole plate therein by a pressure fit between said first interlock member and said second interlock member such that the formed pressure fit between said interlock members is in a direction substantially parallel to a horizontal surface of said sole plate in order to removably and interlockingly secure the sole plate to the truck assembly.

12. The invention according to claim 11, wherein said interlock member on said sole plate includes at least one undercut edge portion thereon, said interlock receptacle on said truck assembly being defined at least in part by a peripheral wall including at least one undercut peripheral wall portion thereon, said undercut peripheral wall portion of said interlock receptacle being adapted to interlockingly and removably engage a corresponding undercut edge portion of said interlock member.

13. The invention according to claim 12, wherein the sole plate includes a number of said interlock members and the truck assembly includes a corresponding number of said interlock receptacles.

14. In a roller skate having a sole plate, a truck assembly for supporting said sole plate, and at least two wheels rotatably mounted on the truck assembly, the improvement wherein the sole plate includes at least one interlock member thereon, said interlock member on said sole plate includes at least one undercut edge portion thereon, said interlock receptacle on said truck assembly being defined at least in part by a peripheral wall including at least one undercut peripheral wall portion thereon, said undercut peripheral wall portion of said interlock receptacle being adapted to interlockingly and removably engage a corresponding undercut edge portion of said interlock member, said truck assembly being split into a pair of truck members removably engageable with one another along mutually mating surfaces thereon, said interlock receptacle and said undercut wall portion being formed in said truck members adjacent said mutually mating surfaces such that said interlock receptacle is bisected into two parts when said truck members are removed from one another, and attachment means are removably securing said truck members to one another in said mutual engagement with said undercut edge portion of said interlock member removably and interlockingly engaging said undercut wall portion of said interlock receptacle in order to removably and interlockingly secure the sole plate to the truck assembly.

15. The invention according to claim 14, wherein the sole plate includes a number of said interlock members and the truck assembly includes a corresponding number of said interlock receptacles at least one of said interlock members being generally plate-shaped in configuration and disposed on a bottom surface of said sole plate, said undercut edge portion of said at least one plate-shaped interlock member being of a generally beveled configuration extending generally upwardly and inwardly toward said bottom surface of said sole plate, said undercut wall portion of at least one of said interlock receptacles being of a generally beveled configuration generally complementary to that of said undercut edge portion of said at least one plate-shaped interlock member in order to removably and interlockingly engage said undercut edge portion of said at least one plate-shaped interlock member when said truck members are attached to one another along said mutually mating surfaces with said truck members engaging said bottom surface of said sole plate.

16. The invention according to claim 15, wherein said at least one plate-shaped interlock member is located on said bottom surface of said sole plate such that said at least one plate-shaped interlock member is bisected into two generally equal parts of the longitudinal centerline of the sole plate, said mutually mating surfaces of said truck members extending generally along the longitudinal centerline of the truck assembly.

17. The invention according to claim 14, wherein the sole plate includes a number of said interlock members and the truck assembly includes a corresponding number of said interlock receptacles, at least one of said interlock members comprising an elongated generally rod-shaped member extending generally longitudinally along a bottom surface of said sole plate and an elongated generally longitudinally-extending interconnecting member between said rod-shaped member and said bottom surface, the lateral width of said interconnecting member being less than that of said rod-shaped member in order to form said undercut peripheral edge portion of said interlock member.

18. The invention according to claim 17, wherein said elongated rod-shaped and interconnecting members extend longitudinally generally along the longitudinal centerline of the sole plate, said mutually mating surfaces of said truck members also extending generally along the longitudinal centerline of the truck assembly, at least one of said interlock receptacles being longitudinally elongated and having a lateral cross-sectional shape generally complementary to that of said rod-shaped and interconnecting members in order to removably and interlockingly engage the same.

19. The invention according to claim 18, wherein at least one other of said interlock members is generally plate-shaped in configuration and disposed on said bottom surface of said sole plate, said undercut edge portion of said at least one plate-shaped interlock member being of a generally beveled configuration extending generally upwardly and inwardly toward said bottom surface of said sole plate, said undercut wall portion of at least one other of said interlock receptacles being of a generally beveled configuration generally complementary to that of said undercut edge portion of said at least one plate-shaped interlock member in order to removably and interlockingly engage the same when said truck members are attached to one another along said mutually mating surfaces with said truck members engaging said bottom surface of said sole plate.

20. The invention according to claim 19, wherein said at least one plate-shaped interlock member is located on said bottom surface of said sole plate such that said at least one plate-shaped interlock member is bisected into two generally equal parts by the longitudinal centerline of the sole plate.

21. The invention according to claim 20, wherein the sole plate includes two of said plate-shaped interlock members and one of said rod-shaped interlock members, one of said plate-shaped interlock members being located at a generally forward portion of said sole plate and the other of said plate-shaped members being located at a generally rearward portion of said sole plate, said rod-shaped interlock member being located at an intermediate location on said sole plate generally between said plate-shaped interlock members, the interlock members being located at corresponding locations on the truck assembly.

22. The invention according to claim 14, wherein the sole plate comprises the sole portion of a footware item.

23. The invention according to claim 14, wherein the sole plate is adapted to be secured to the sole portion of a footware item.

24. A roller skate comprising a support structure comprising a truck assembly including two truck members, one of said truck members having an undercut edge along the longitudinal axis of the skate and the other of said truck members having a corresponding surface, a number of wheels rotatably mounted on said support structure, and a stop member removably securable to an end portion of said support structure, said stop member including an interlock member thereon, said support structure including an interlock receptacle thereon, said interlock receptacle surrounding said interlock member for interlockingly and removably receiving said interlock member by a pressure fit between said interlock member and interlock receptacle such that the formed pressure fit between said interlock member and receptacle is in a direction substantially parallel to a horizontal surface of said support structure.

25. A roller skate according to claim 24, wherein said interlock member on said top member includes at least one undercut edge portion thereon, said interlock receptacle on said support assembly being defined in part by a peripheral wall including at least one undercut peripheral wall portion thereon, said undercut peripheral wall portion of said interlock receptacle being adapted to interlockingly and removably engage a corresponding undercut edge portion of said interlock member.

26. A roller skate comprising a support structure, a number of wheels rotatably mounted on said support structure, and a stop member removably securable to an end portion of said support structure, said stop member including an interlock member thereon, said support structure including an interlock receptacle thereon, said interlock member on said stop member includes at least one undercut edge portion thereon, said interlock receptacle on said support assembly being defined in part by a peripheral wall including at least one undercut peripheral wall portion thereon, said undercut peripheral wall portion of said interlock receptacle being adapted to interlockingly and removably engage a corresponding undercut edge portion of said interlock member, and said support structure including a pair of truck members removably engageable with one another along mutually mating surfaces thereon, said interlock receptacle and said undercut wall portion being formed in said truck support adjacent said mutually mating surfaces such that said interlock receptacle is bisected into two parts when said truck members are removed from one another, and attachment means for removably securing said truck members to one another in said mutual engagement with said undercut edge portion of said interlock member removably and interlockingly engaging said undercut wall portion of said interlock receptacle in order to removably and interlockingly secure said stop member to said support structure.

27. A roller skate according to claim 26, wherein said interlock member is generally plate-shaped in configuration and disposed on a lower surface of said support structure, said undercut edge portion of said plate-shaped interlock member being of a generally beveled configuration extending generally upwardly and inwardly toward said lower surface of said support structure, said undercut wall portion of said interlock receptacle being of a generally beveled configuration generally complementary to that of said undercut edge portion to said interlock member in order to removably and interlockingly engage said undercut edge portion of said plate-shaped interlock member when said truck members are attached to one another along said mutually mating surfaces.

28. A roller skate according to claim 24, wherein said stop member includes a base portion, said interlock member being located on said base portion, and a friction member threadably attached to said base member.

29. A roller skate according to claim 28, wherein said friction member is selectively rotatable in order to selectively adjust the position thereof relative to said base member.

* * * * *